US006857965B2

(12) United States Patent
Pook et al.

(10) Patent No.: US 6,857,965 B2
(45) Date of Patent: Feb. 22, 2005

(54) SUSPENSION SWING WITH A RECLINE MECHANISM AND A METHOD OF USING THE SAME

(75) Inventors: Peter Pook, Delray Beach, FL (US); Gerald P. Sitarski, Grand Island, NY (US); Mark Wojtkiewicz, Lancaster, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/378,655

(22) Filed: Mar. 5, 2003

(65) Prior Publication Data

US 2004/0198510 A1 Oct. 7, 2004

(51) Int. Cl.[7] ..... A63G 9/12
(52) U.S. Cl. ..... 472/118; 297/273
(58) Field of Search ..... 472/118, 119, 472/125; 297/273, 277, 278

(56) References Cited

U.S. PATENT DOCUMENTS

| | | | | |
|---|---|---|---|---|
| 122,066 | A | | 12/1871 | Scriven et al. |
| 136,181 | A | | 2/1873 | Quigg |
| 285,665 | A | | 9/1883 | Peck |
| 402,469 | A | | 4/1889 | Messmore |
| 479,524 | A | | 7/1892 | Nicholson |
| 550,396 | A | | 11/1895 | Seaberg |
| 906,120 | A | | 12/1908 | Draper |
| 1,055,975 | A | | 3/1913 | Hawk |
| 1,140,211 | A | | 5/1915 | Thomas |
| 1,369,799 | A | | 3/1921 | Gardner |
| 2,167,794 | A | | 8/1939 | Bentz |
| 2,532,953 | A | | 12/1950 | Scott |
| 2,704,116 | A | | 3/1955 | Scanlon |
| 3,069,202 | A | | 12/1962 | Gottfried et al. |
| 3,206,247 | A | | 9/1965 | Johnson |
| 3,563,600 | A | | 2/1971 | Converse |
| 3,572,827 | A | | 3/1971 | Merelis et al. |
| 3,594,040 | A | | 7/1971 | Monroe |
| 3,632,163 | A | | 1/1972 | Burnham |
| 4,084,849 | A | | 4/1978 | Ishida et al. |
| 4,240,625 | A | | 12/1980 | Meeker |
| 4,325,578 | A | | 4/1982 | Borucki |
| 4,447,087 | A | | 5/1984 | Massonnet |
| 4,940,229 | A | | 7/1990 | Foster |
| 5,058,951 | A | | 10/1991 | Thiel |
| 5,161,522 | A | * | 11/1992 | Clevenger ..... 601/24 |
| 5,562,548 | A | * | 10/1996 | Pinch et al. ..... 472/119 |
| 5,593,207 | A | | 1/1997 | Turner |
| 5,769,727 | A | | 6/1998 | Fair et al. |
| 5,975,631 | A | | 11/1999 | Fair et al. |
| 5,984,791 | A | | 11/1999 | Fair et al. |
| 6,027,409 | A | * | 2/2000 | Favorito et al. ..... 472/118 |
| 6,416,132 | B1 | | 7/2002 | Norton et al. |
| 6,561,915 | B2 | * | 5/2003 | Kelly et al. ..... 472/119 |

* cited by examiner

*Primary Examiner*—K. T. Nguyen
(74) *Attorney, Agent, or Firm*—Cooley Godward LLP

(57) ABSTRACT

A suspension swing including a seat and a recline mechanism is disclosed. The angle of inclination of the seat can be adjusted using the recline mechanism. In one embodiment, the recline mechanism includes a movable member that is coupled to the seat for movement relative thereto.

24 Claims, 9 Drawing Sheets

FIG. 4
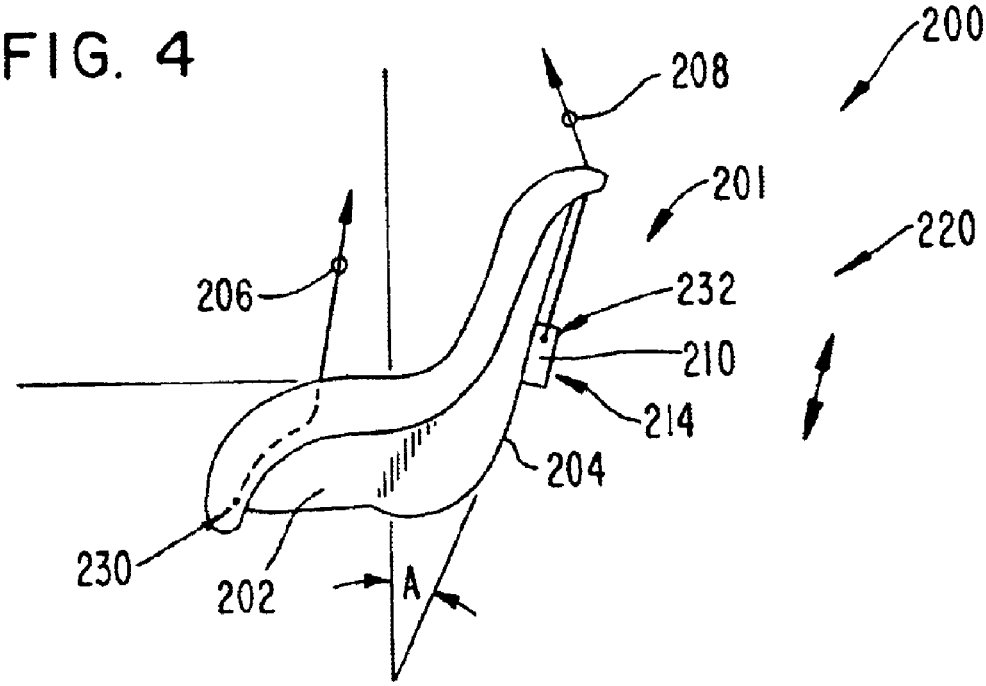
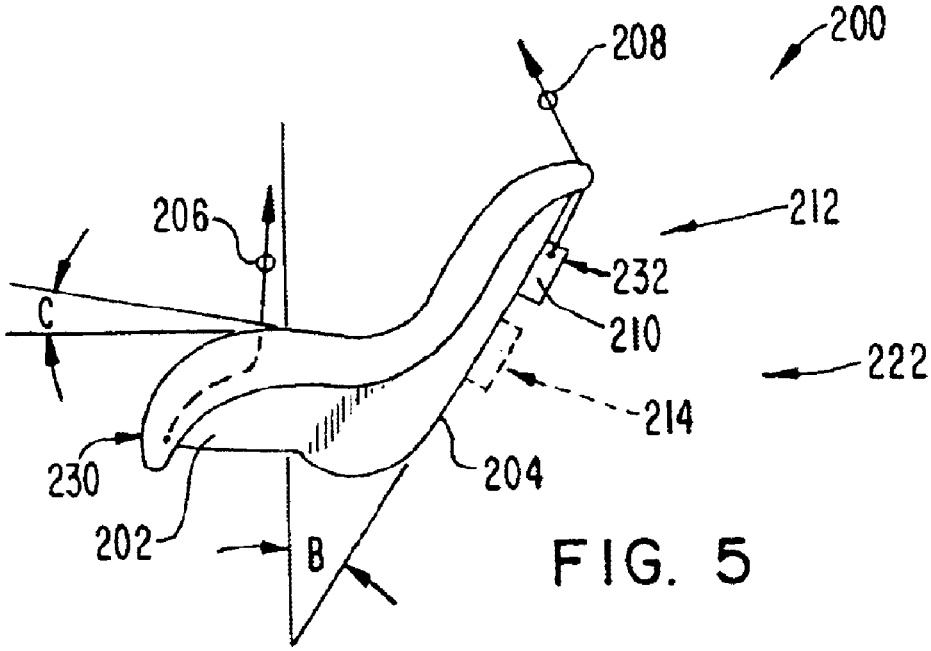
FIG. 5

FIG. 9
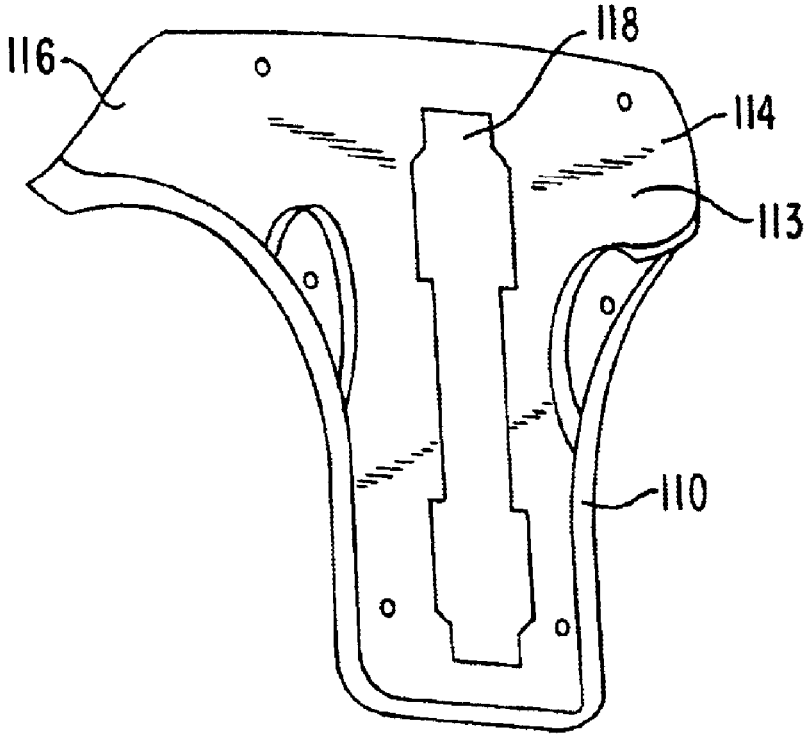
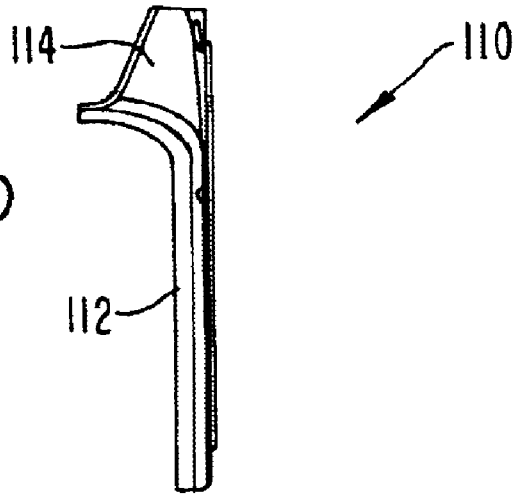
FIG. 10

SUSPENSION SWING WITH A RECLINE MECHANISM AND A METHOD OF USING THE SAME

BACKGROUND OF THE INVENTION

This invention relates generally to a suspension swing, and more particularly, to a suspension swing with a recline mechanism.

Suspension swings are generally known. Suspension swings include swings that can be supported from any structure using one or more suspension lines. Conventional suspension swings do not include any type of recline mechanism. Thus, there is no mechanism that enables a parent or caregiver to adjust the angle of inclination of the seat.

A need exists for a suspension swing with a recline mechanism. Also, a need exists for an easily adjustable recline mechanism for a suspension swing.

SUMMARY OF THE INVENTION

In one embodiment, a suspension swing includes a seat and a recline mechanism. In one embodiment, the suspension swing includes a tray that can be disposed proximate to the seat. In one embodiment, the recline mechanism includes a movable member that is coupled to the seat. The movable member can be mounted for movement relative to the seat.

In one embodiment, the recline mechanism includes a coupler that is coupled to the seat. The coupler can be configured to guide the movement of the movable member relative to the seat. In one embodiment, the seat can be positioned in multiple positions or configurations, including an upright position or configuration and in a reclined position or configuration.

BRIEF DESCRIPTION OF THE DRAWINGS

FIG. 4 is a schematic side view of an embodiment of a suspension swing according to the present invention in an upright configuration.

FIG. 5 is a schematic side view of the suspension swing of FIG. 4 in a reclined configuration.

FIG. 9 is a front view of the coupler of FIG. 8.

FIG. 10 is a side view of the coupler of FIG. 8.

DETAILED DESCRIPTION OF THE INVENTION

In one embodiment, a suspension swing includes a seat and a recline mechanism. In one embodiment, the suspension swing includes a tray that can be disposed proximate to the seat. In one embodiment, the recline mechanism includes a movable member that is coupled to the seat. The movable member can be mounted for movement relative to the seat.

In one embodiment, the recline mechanism includes a coupler that is coupled to the seat. The coupler can be configured to guide the movement of the movable member relative to the seat. In one embodiment, the seat can be positioned in multiple positions or configurations, including an upright position or configuration and in a reclined position or configuration.

Figure 1:
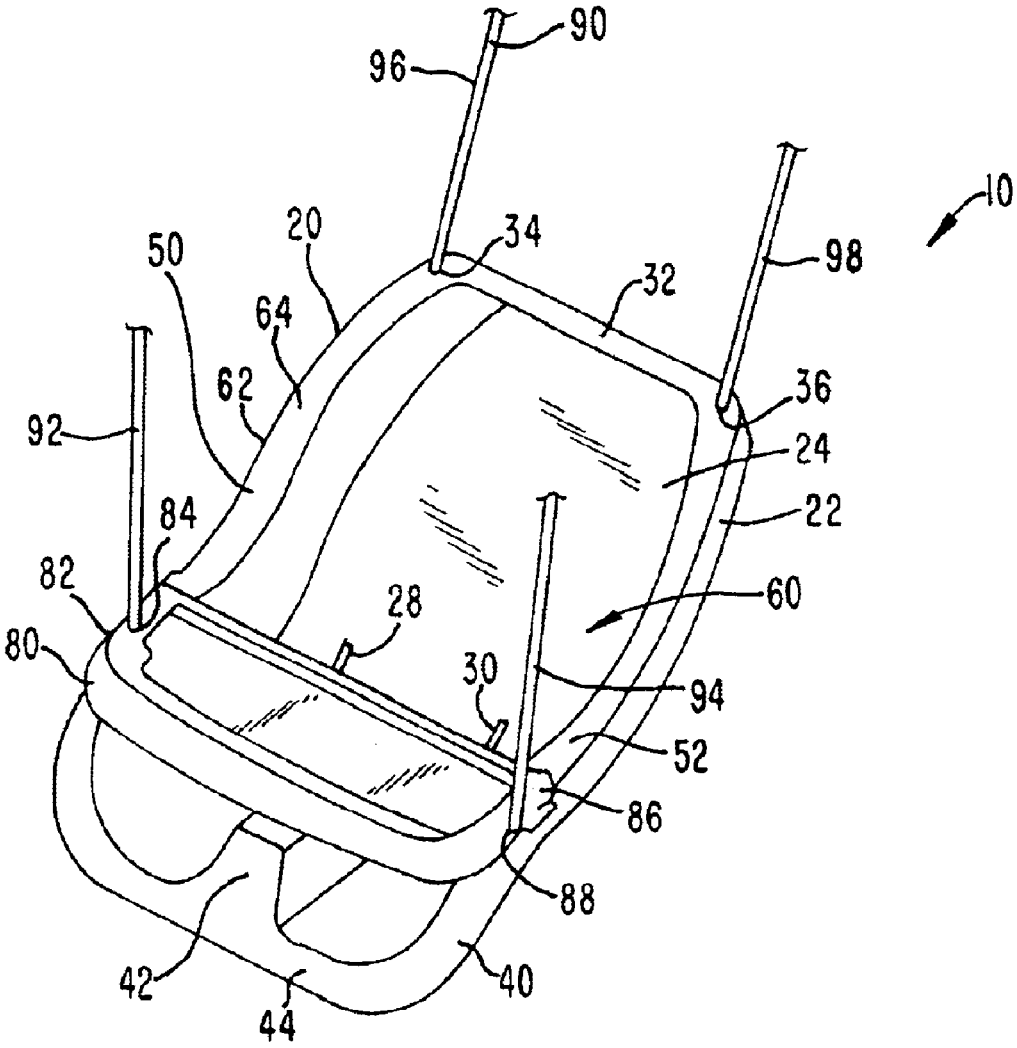
FIG. 1 is a front perspective view of an embodiment of a suspension swing according to the present invention.

A front perspective view of an embodiment of the suspension swing according to the present invention is illustrated in FIG. 1. In this embodiment, the suspension swing 10 includes a seat 20 and a tray 80.

The seat 20 also includes a suspension line 90 that is used to suspend the seat 20 from a support structure. In one embodiment, the suspension line 90 includes line portions 92, 94, 96 and 98. Line portions 92 and 94 are coupled together and line portions 96 and 98 are coupled together. Line portions 92 and 96 form a continuous line portion and line portions 94 and 98 form a continuous line portion. In another embodiment, line portions 92, 94, 96 and 98 are part of one continuous suspension line.

In the illustrated embodiment, the seat 20 includes an upper portion 22 and a lower portion 40. The upper portion 22 and the lower portion 40 are integrally formed. In an alternative embodiment, the upper portion 22 and the lower portion 40 may be formed separately and coupled together for movement relative to each other.

Figure 2:
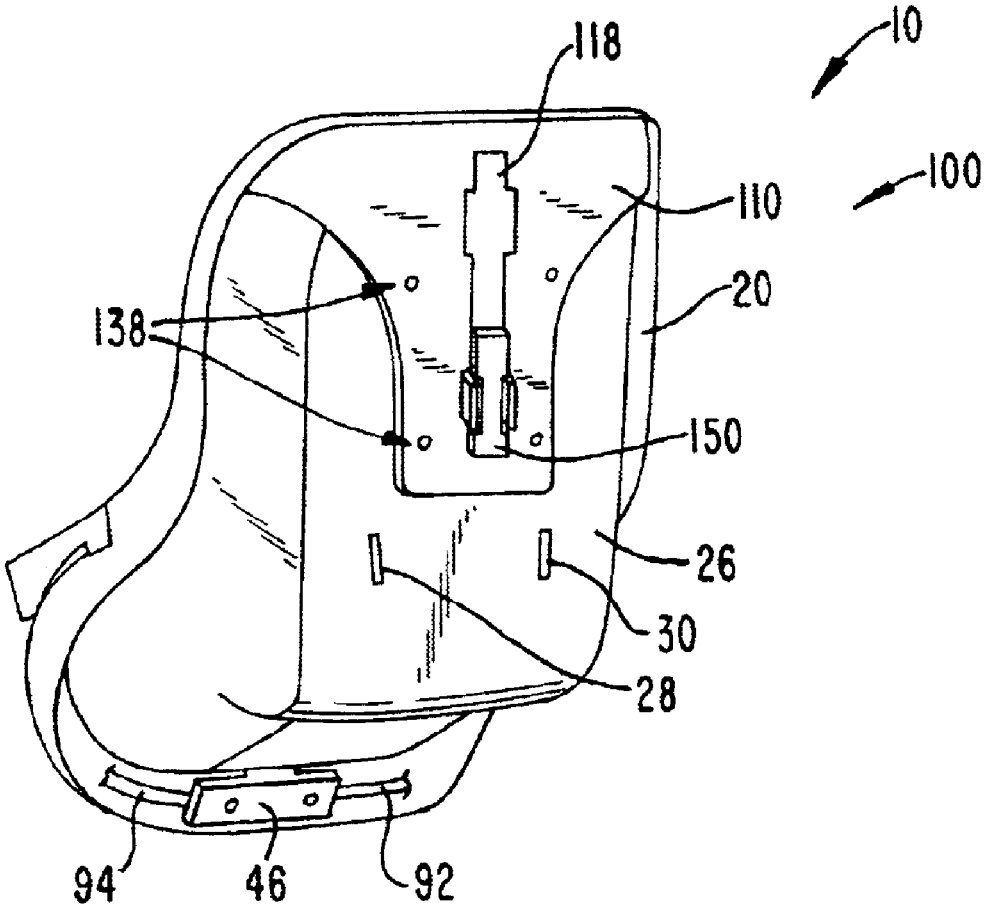
FIG. 2 is a rear perspective view of the suspension swing of FIG. 1.

The upper portion 22 includes a front surface 24 and a rear surface 26 (see FIG. 2). The upper portion 22 includes slots 28 and 30 that extend through the seat 20. Slots 28 and 30 are configured to receive straps or other retaining devices. In one embodiment, straps 66 and 68 (see FIGS. 6 and 7) are inserted through slots 28 and 30 and can include a coupler such as a buckle (not shown) to retain an infant in the seat 20.

Referring to FIG. 1, the upper portion 22 includes an upper end 32 in which openings 34 and 36 are formed. Openings 34 and 36 are configured to receive line portions 96 and 98, respectively.

The lower portion 40 includes a retainer portion 42 and a lower front end 44. The retainer portion 42 is configured to retain an infant in the seat 20 and inhibit an infant from sliding out of the seat 20 beneath the tray 80. In this embodiment, the retainer portion 42 is formed integrally with the seat 20.

In the illustrated embodiment, the seat 20 also includes arm portions 50 and 52. Arm portions 50 and 52 include openings (not shown) that are configured to receive line portions 92 and 94.

The upper portion 22, the lower portion 40 and the arm portions 50 and 52 form a perimeter 62 that defines a support area 60 in which an infant can be supported. The seat 20 includes a shoulder 64 that extends around the perimeter 62.

Referring to FIG. 1, the tray 80 includes a pivoting end 82 and a releasable end 86. The tray 80 is configured to pivot about pivoting end 82. The tray 80 can be pivoted so that a parent or caregiver can access an infant located in the support area 60.

The pivoting end 82 of the tray 80 includes an opening 84 through which line portion 92 passes. Similarly, the releasable end 86 includes an opening 88 through which line portion 94 passes. In one embodiment, the opening 88 is an open slot that enables line portion 96 to be moved into and out of engagement with the releasable end 86 of the tray 80.

The tray 80 also includes a conventional molded-in latch at one or both ends that can be manipulated into and out of engagement with the corresponding arm portions 50 and 52 of the seat 20.

The swing 10 includes a line retainer 46 as illustrated in FIG. 2. The line retainer 46 is coupled to a lower surface of the seat 20 using conventional fasteners, such as screws. After the ends of line portions 92 and 94 are coupled together, the line portions 92 and 94 are retained proximate to the lower portion of the seat 20 via line retainer 46 which is attached to the seat 20.

In the illustrated embodiment, the swing 10 includes a recline mechanism 100. The recline mechanism 100 can be used to change the angle of inclination of the seat 20. As illustrated in FIG. 2, the recline mechanism 100 is attached to the rear surface 26 of the seat 20. In alternative embodiments, the recline mechanism 100 can be attached to the seat 20 at any appropriate location. The particular embodiment of the recline mechanism 100 described with respect to FIGS. 2 and 3 is exemplary of only one of many types of recline mechanisms according to the invention.

In the illustrated embodiment, the recline mechanism 100 includes a coupler 110 and a movable member 150. The coupler 110 is attached to the rear surface 26 of the seat 20. In one embodiment, the coupler 110 includes several openings 138 through which conventional fasteners, such as screws or rivets, can be inserted to attach the coupler 110 to the seat 20.

In one embodiment, the coupler 110 includes an opening 118 formed therein. The opening 118 extends along a portion of the coupler 110. The particular configuration of the opening 118 is described in detail with respect to FIGS. 8 and 9.

Figure 3:
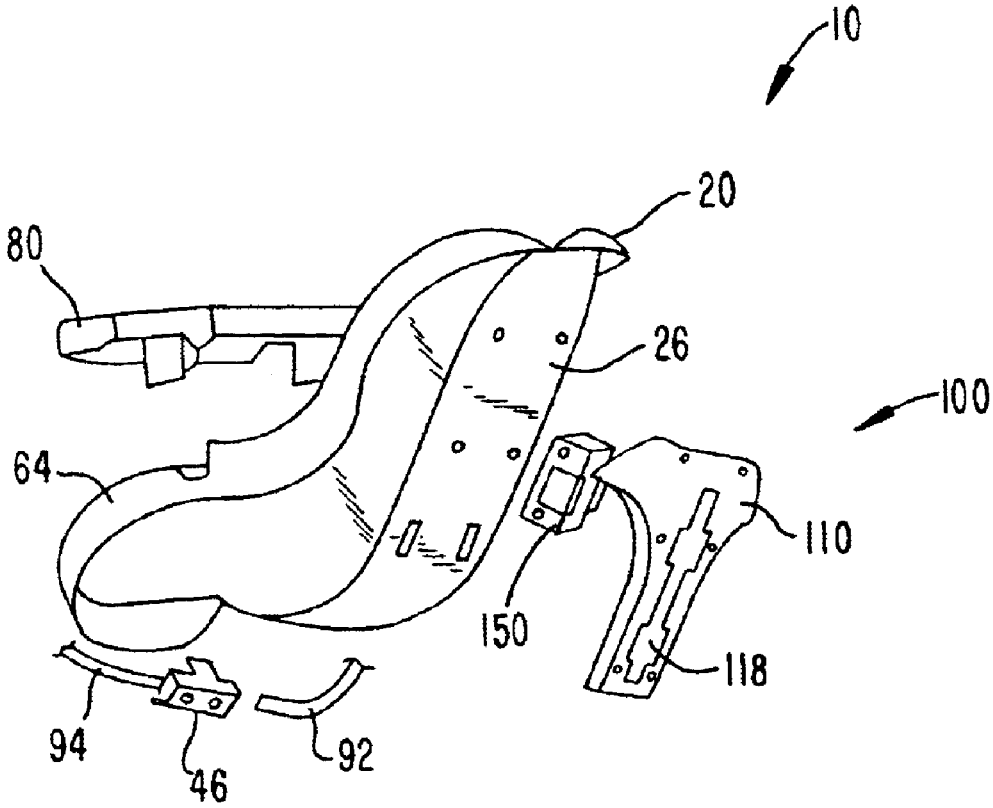
FIG. 3 is an exploded rear perspective view of the suspension swing of FIG. 1.

Referring to FIGS. 2 and 3, the recline mechanism 100 includes a movable member 150 that engages the opening 118 in the coupler 110. The movable member 150 is located between the seat rear surface 26 and a portion of the coupler 110. The movable member 150 can be retained in two different positions with respect to the seat 20. In alternative embodiments, the movable member 150 can be moved into and retained in any number positions with respect to the seat 20.

A schematic view of a suspension swing according to the present invention is illustrated in FIGS. 4 and 5. In this embodiment, the swing 200 includes a seat 202 that has a rear surface 204. The swing 200 includes a front suspension line portion 206 and a rear suspension line portion 208. Each line portion 206 and 208 is representative of one or more suspension lines that can be used to support the swing 200 from any type of support structure, such as a pole, a bar, a portion of a tree, etc.

The path of the front suspension line portion 206 is illustrated in FIGS. 4 and 5. The front suspension line portion 206 passes through a portion of the seat 202 and extends beneath and along the front end of the seat 202 proximate to line support location 230. Line support location 230 represents the location at which the front suspension line portion 206 supports the seat 202. In this embodiment, line support location 230 extends beneath the front of the seat 202.

The path of rear suspension line portion 208 is also illustrated in FIGS. 4 and 5. The rear suspension line portion 208 passes through an upper end of the seat 202. A portion of the path of the rear suspension line portion 208 is illustrated by line support location 232. Line support location 232 represents the location at which the seat 202 is supported by suspension line portion 208.

In this embodiment, the swing 200 includes a recline mechanism 201. The recline mechanism 201 can be manipulated to change the configuration of the seat 202. As illustrated, the seat 202 can be disposed in an upright configuration 220 (see FIG. 4) and in a reclined configuration 222 (see FIG. 5).

The recline mechanism includes a movable member 210. In one embodiment, the rear suspension line portion 208 is coupled to the movable member 210. Thus, line support location 232 is associated with movable member 210.

The movable member 210 is mounted for a range of movement with respect to the rear surface 204 of the seat 202. The movable member 210 can be disposed in a lower position 214 (see FIG. 4) and in an upper position 212 (see FIG. 5). In alternative embodiments, the movable member 210 can be disposed in any number of positions relative to the seat 202.

When the movable member 210 moves relative to the seat 202, the line support location 232 moves and the length of the rear suspension line portion 208 above the upper end of the seat 202 increases. When that length increases, the upper end of the seat 202 moves downwardly and the seat 202 is reclined. When that length decreases, the upper end of the seat 202 moves upwardly and the seat 202 is disposed in a more upright configuration.

In the illustrated embodiment, the movable member 210 is slidably coupled to the rear surface 204 of the seat 202. In alternative embodiments, the movable member 210 can be mounted for any type of movement relative to the seat 202, including rotational movement outwardly from the rear surface. Any type of movement is permitted so long as the rear suspension line portion 208 and line support location 232 can be moved relative to the seat 202.

As the movable member 210 and the line support location 232 move upwardly, the length of the rear suspension line portion 208 located above the upper end of the seat 202 increases and the angle of inclination of the seat 202 increases. As illustrated in FIG. 4, angle A is the angle between the back portion of the seat 202 and a vertical plane. In one embodiment, angle A can be approximately 30 degrees.

Referring to FIG. 5, angle B represents the angle between the back portion of the seat 202 and a vertical plane. In one embodiment, angle B can be approximately 45 degrees. In this embodiment, angle C, which represents the change in orientation of the seat 202 with respect to a horizontal plane, is approximately 15 degrees. The change in the inclination of the seat 202 is a function of the distance that the movable member 210 and the line support point 232 move relative to the seat 202.

Figure 6:
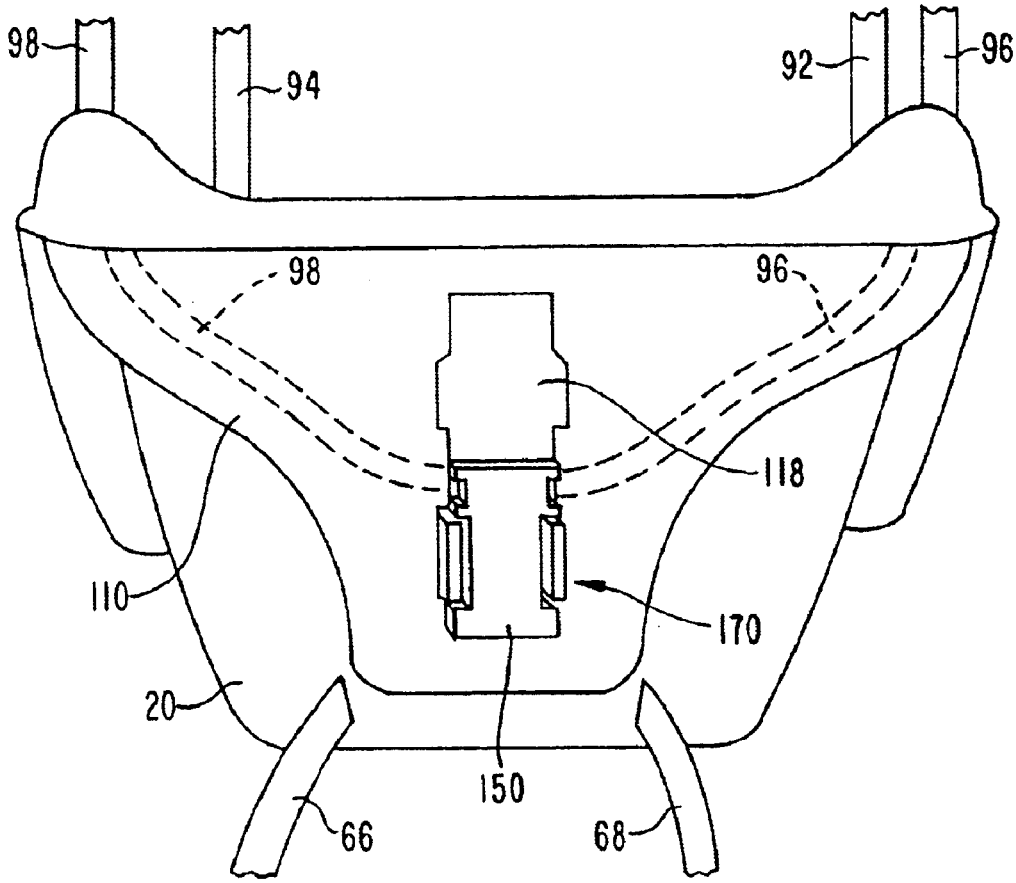
FIG. 6 is a rear view of the suspension swing of FIG. 1 in an upright configuration.
Figure 7:
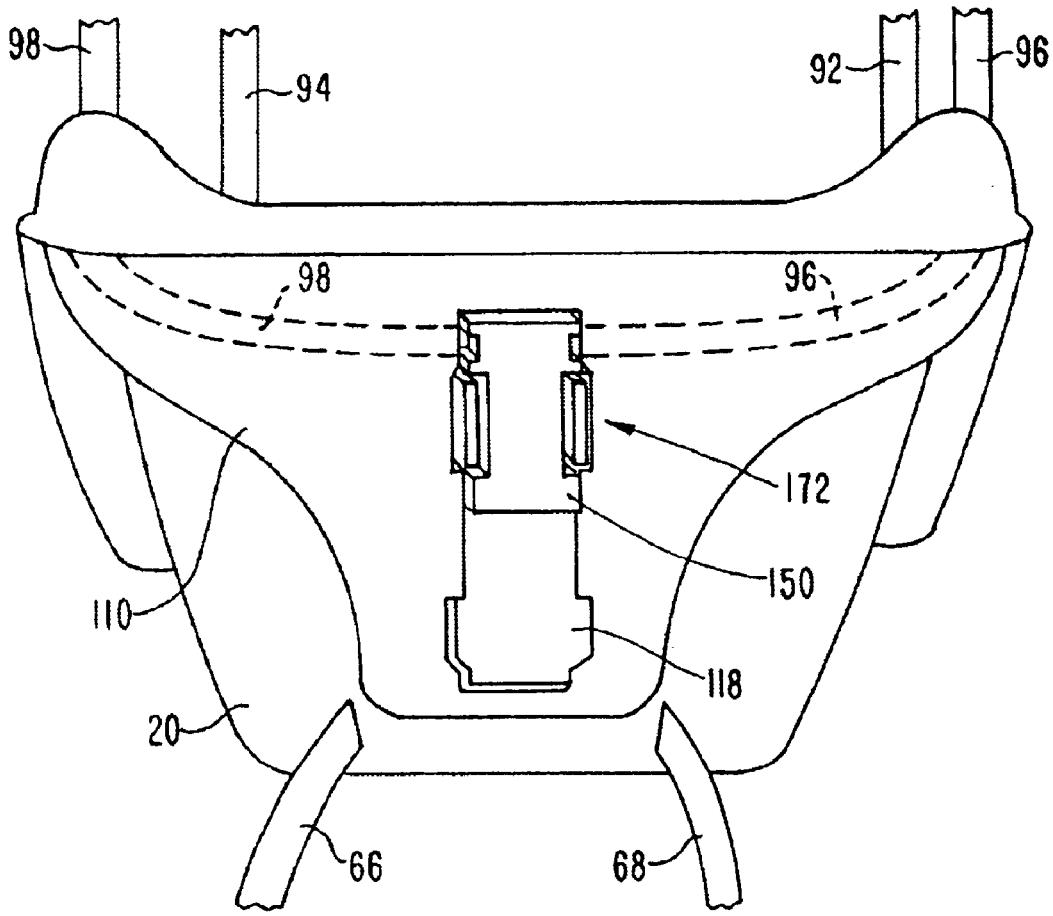
FIG. 7 is a rear view of the suspension swing of FIG. 1 in a reclined configuration.

Referring FIGS. 6 and 7, the suspension swing 10 is discussed in greater detail. The swing 10 can be disposed in an upright configuration in which the movable member 150 is located in its lower position 170 (see FIG. 6). The swing 10 can be disposed in a reclined configuration in which the movable member 150 is located in its upper position 172 (see FIG. 7). The structure of movable member 150 is discussed in more detail relative to FIG. 11.

The line portions 96 and 98 are coupled to the movable member 150. The amount of the line portions 96 and 98 that extend above the seat 20 can be changed by moving the movable member 150. As the movable member 150 moves upwardly, the lengths of the portions of the line portions 96 and 98 above the seat 20 increase and the angle of inclination of the seat 20 with respect to a vertical plane increases. As the movable member 150 moves downwardly, the portions of the line portions 96 and 98 above the seat 20 decrease and the seat 20 is in a more upright configuration.

Figure 8:
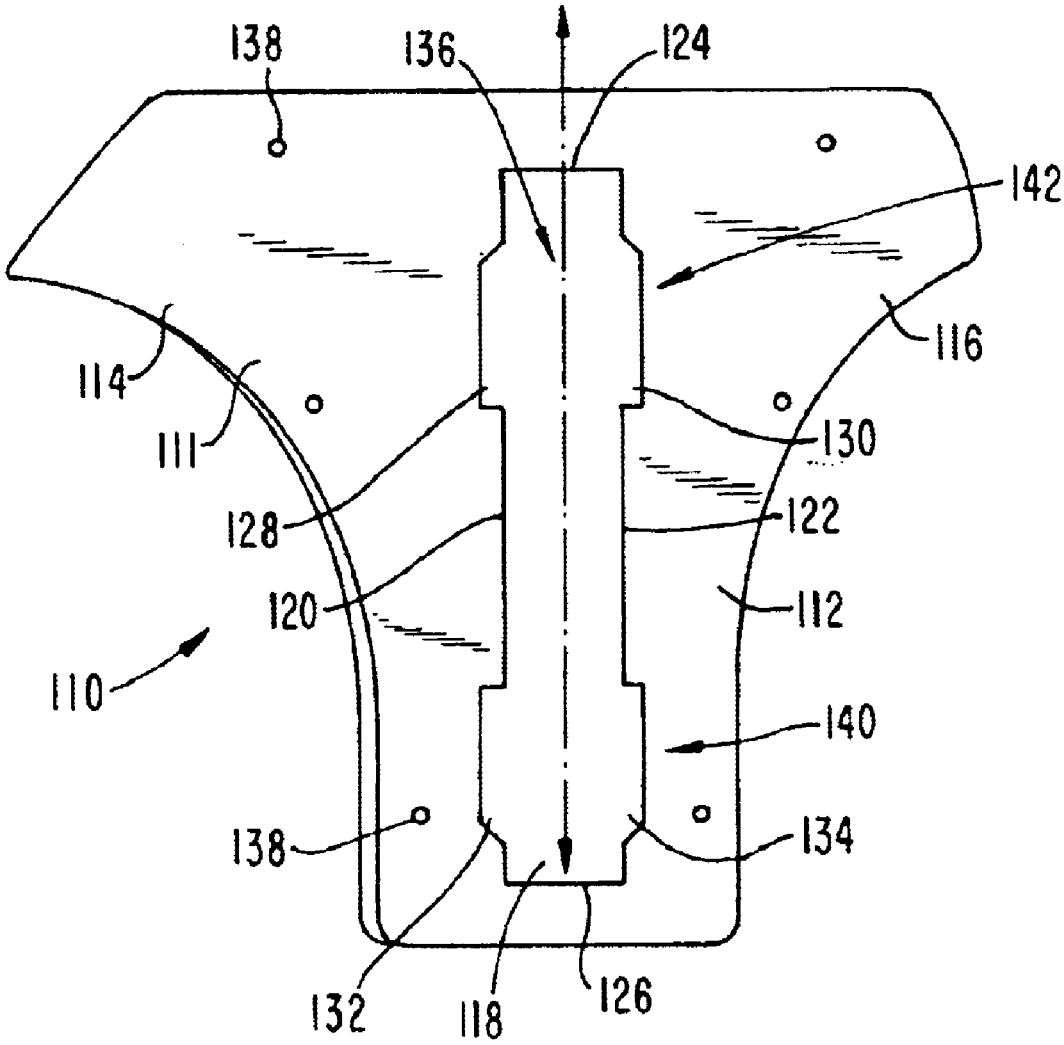
FIG. 8 is a rear view of an embodiment of a coupler according to the present invention.

An embodiment of a coupler according to the present invention is illustrated in FIGS. 8-10. In this embodiment, the coupler 10 includes a body portion 112 and side portions 114 and 116. The body portion 112 includes an outer surface 111 and an inner surface 113. The side portions 114 and 116 have curved configurations that correspond to the curvature of the rear surface of the seat 20. The coupler 110 can also include several openings 138 through which conventional fasteners, such as screws or rivets, can be used to attach the coupler 110 to the seat 20.

As illustrated, the coupler 110 includes an opening 118 that is formed in the body portion 112. The coupler 110 includes sidewalls 120 and 122 and end walls 124 and 126 that define the opening 118 therebetween. In alternative embodiments, the opening 118 can have any shape or configuration that can receive the movable member 150.

Each sidewall 120 and 122 includes several recesses that define different positions in which the movable member 150 can be retained. In particular, sidewall 120 includes an upper recess 128 and a lower recess 132. Similarly, sidewall 122 includes an upper recess 130 and a lower recess 134. Upper recesses 128 and 130 are substantially aligned with each other and define a first location 142. Similarly, lower recesses 132 and 134 are substantially aligned with each other and define a second location 140. As illustrated in FIG. 8, the opening 118 also includes a longitudinal axis 136.

When the movable member 150 is located proximate to recesses 132 and 134, the seat 20 is in an upright configuration. When the movable member 150 is located proximate to recesses 128 and 130, the seat 20 is in a reclined configuration. The terms "upright" and "reclined" are intended to represent two different configurations of the seat. The upright and reclined configurations can be any different configurations and the configurations are not required to be a particular angle with respect to a reference plane.

Figure 11:
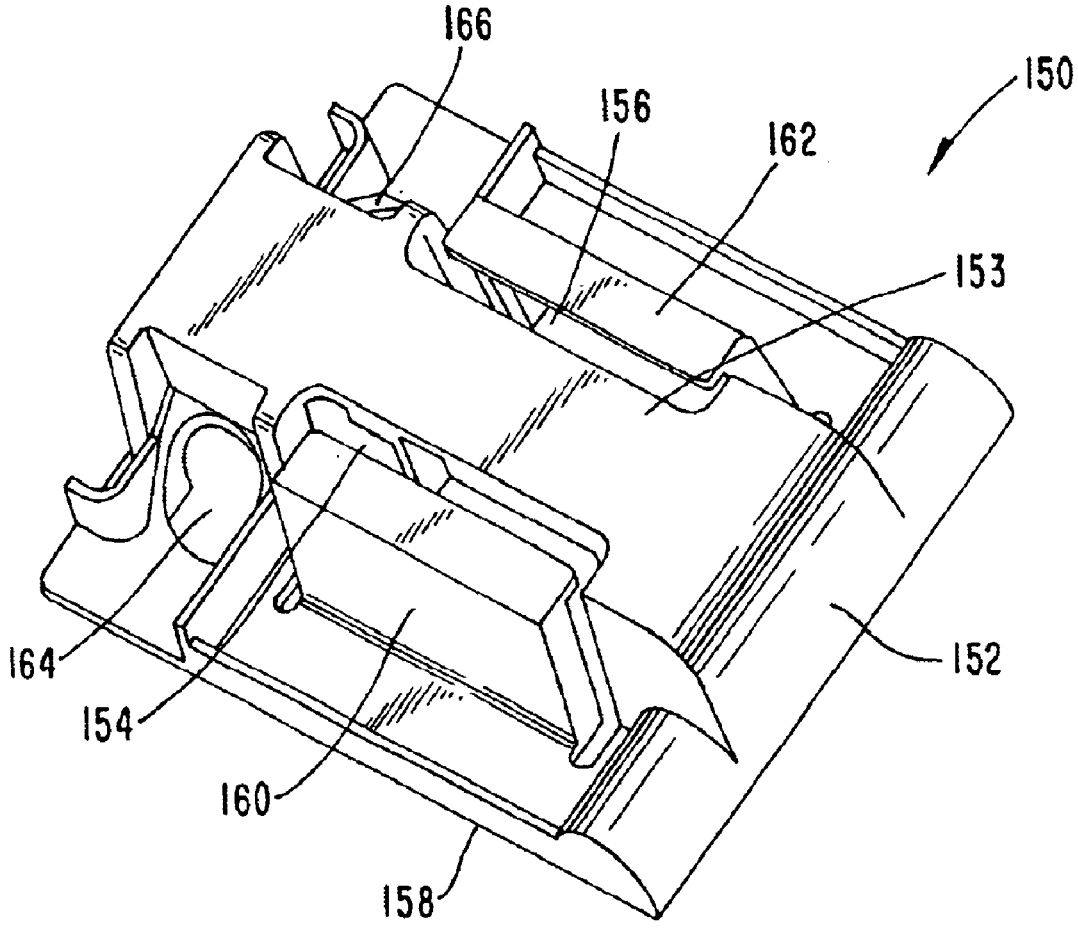
FIG. 11 is a perspective view of an embodiment of a movable member according to the present invention.

An embodiment of a movable member according to the present invention is illustrated in FIG. 11. In this embodiment, the movable member 150 includes a housing 152 with a center portion 153. The center portion 153 includes a recess 154 formed on one side and a recess 156 formed on an opposite side. The housing 152 includes a lower surface 158 that is disposed proximate to the rear surface 26 of the seat 20.

In this embodiment, the movable member 150 includes locking portions 160 and 162. Locking portions 160 and 162 are integrally formed with the housing 152. Each locking portion is resiliently coupled to a portion of the housing 152 and can be moved relative to the center portion 153.

Locking portions 160 and 162 are configured to retain the movable member 150 in a particular position along the opening 118 of the coupler 110. Locking portion 160 is configured to engage recess 128 when the movable member 150 is in its upper position 172 and to engage recess 132 when the movable member 150 is in its lower position 170. Similarly, locking portion 162 is configured to engage recess 130 when the movable member 150 is in its upper position 172 and to engage recess 134 when the movable member is in its lower position 170.

Movable member 150 includes openings 164 and 168. Line portions 96 and 98 are inserted through openings 168 and 164, respectively, to attach the line portions to movable member 150.

To adjust the position of the movable member 150, a user moves the locking portions 160 and 162 toward each other to disengage the locking portions 160 and 162 from the corresponding recesses of opening 118. When locking portions 160 and 162 are disengaged, the movable member 150 can move along the opening 118.

To recline the swing seat 20, a user moves the locking portions 160 and 162 toward each other and moves the movable member 150 along the opening 118 to its upper position 172. When the user releases the locking portions 160 and 162, the locking portions 162 and 160 move apart to their resting positions and engage recesses 128 and 130, respectively.

To move the seat 20 into an upright configuration, a user moves the locking portions 160 and 162 toward each other and moves the movable member 150 along the opening 118 to its lower position 170. When the user releases the locking portions 160 and 162, the locking portions 160 and 162 engage recesses 132 and 134, respectively, and the movable member 150 is retained in its lower position 170.

In one embodiment, the seat and the recline mechanism components can be formed from molded plastic. Alternatively, any material with sufficient strength that allows the seat to support an infant can be used.

Many components of a suspension swing can change in alternative embodiments according to the invention. In alternative embodiments, the configuration of the movable member can change. For example, the movable member can include a biasing mechanism, such as a spring, that biases the locking portions away from each other. In another embodiment, the movable member can include a single locking portion. In another embodiment, one or more of the locking portions can be formed separately from the housing of the movable member and coupled thereto. Alternatively, locking portions on a movable member can have different configurations. Alternatively, the locking portions do not have to be symmetrically coupled to the movable member. In another embodiment, each locking portion can be located at any location on the movable member. In one embodiment, the openings for the suspension lines in the movable member can be located anywhere on the movable member.

In another embodiment, the recline mechanism can include multiple movable members. Each movable member can include one or more locking portions.

In another embodiment, the coupler of the recline mechanism can have any length or configuration. The opening of the coupler also can have any length or configuration that enables the movable member to be located at two ore more different positions.

In another embodiment, the coupler and the movable member can have any types of locking structures that enable the movable member to retained in a particular position. For example, the movable member can include several recesses and the coupler can include locking portions that are configured to engage the recesses.

In another embodiment, the movable member is attached to line portions 92 and 94, rather than line portions 96 and 98. The relative inclination of the seat 20 can thus be changed by changing the amount of line portions 92 and 94 extending above seat 20.

The line portions may be formed of any suitable, including natural or synthetic fiber ropes and metal cable.

While the invention has been described in detail and with reference to specific embodiments thereof, it will be apparent to one skilled in the art that various changes and modifications may be made therein without departing from the spirit and scope thereof. Thus, it is intended that the present invention covers the modifications and variations of this invention provided they come within the scope of the appended claims and their equivalents.

What is claimed is:

1. A swing, comprising:

a seat, said seat including an upper end;

a movable member, said movable member being coupled to said seat, said movable member being disposable in a first position relative to said seat upper end and in a second position relative to said seat upper end;

a first flexible suspension line portion, said first flexible suspension line portion being coupled to said seat at a first location, said first flexible suspension line portion being configured to be coupled to a support member; and a second flexible suspension line portion said second flexible suspension line portion being one of a rope and a cable, said second flexible suspension line portion being coupled to said movable member at a second location, said second flexible suspension line portion being configured to be coupled to the support member, wherein a distance between said second location and said seat upper end changes when the movable member is moved from said first position to said second position, said seat being disposed in a first configuration when said movable member is in said first position and in a second configuration when said movable member is in said second position, said first configuration being different than said second configuration.

2. The swing of claim 1, wherein said second location is movable relative to said first location.

3. The swing of claim 1, wherein said seat includes a rear surface, and said movable member is coupled to said rear surface.

4. The swing of claim 1, further comprising:

a coupler, said coupler being coupled to said seat, said coupler including an opening, said movable member being disposed in said opening.

5. The swing of claim 4, wherein said coupler includes first and second side walls that define a portion of said opening, said first side wall including an upper recess and a lower recess, and said second side wall including its own upper recess and its own lower recess.

6. The swing of claim 5, wherein said movable member engages said upper recesses when said movable member is in said second position.

7. The swing of claim 5, wherein said movable member includes a locking portion, said locking portion being configured to engage one of said recesses.

8. The swing of claim 1, wherein said first configuration is an upright configuration and said second configuration is a reclined configuration.

9. The swing of claim 8, wherein the distance between said second position and said seat upper end is less than the distance between said first position and said seat upper end.

10. A suspension swing, the suspension swing being disposable in a first configuration and in a second configuration, the suspension swing comprising:

a seat, said seat having an upper portion and a lower portion, said upper portion including an upper end, said seat including a front suspension line portion and a rear suspension line portion, said front suspension line portion being coupled to said seat; and a recline mechanism, said recline mechanism including a movable member coupled to said seat, said rear suspension line portion being coupled to said movable member, said movable member having a range of movement relative to said seat.

11. The suspension swing of claim 10, wherein said recline mechanism includes a coupler coupled to said seat, said movable member cooperatively engaging said coupler, said coupler being configured to guide said movable member for movement relative to said seat.

12. The suspension swing of claim 10, wherein said movable member is selectively disposable in a first position and in a second position relative to said seat, the distance between said movable member in said first position and said seat upper end being different than the distance between said movable member in said second position and said seat upper end.

13. The suspension swing of claim 10, wherein said rear suspension line portion is coupled to said movable member at a support location, and movement of said movable member causes movement of said support location relative to said seat.

14. A method of adjusting the configuration of a suspension swing, the swing including a seat and a movable member coupled to the seat, the movable member being selectively disposable in a first position and in a second position, the swing being supported at a first support location and at a second support location, the movable member including the second support location, the method comprising:

disposing the swing in a first configuration; and moving the movable member relative to the seat from the first position to the second position, the swing being in the first configuration when the movable member is in the first position and in a second configuration when the movable member is in the second position, the second configuration being different than the first configuration.

15. The method of claim 14, said disposing the swing in a first configuration includes moving the movable member to the first position and retaining the movable member in the first position.

16. The method of claim 14, said moving the movable member including moving the second support location from the first position to the second position.

17. A suspension swing, comprising:

a seat, said seat being selectively disposable in a first configuration and in a second configuration;

a first suspension line portion, said first suspension line portion being coupled to said seat;

a second suspension line portion; and means for adjusting the inclination of said seat, said means for adjusting being coupled to said seat, said second suspension line portion being coupled to said means for adjusting, said means for adjusting being configured to adjust said second suspension line portion relative to said seat to dispose said seat in one of said first configuration and said second configuration.

18. The suspension swing of claim 17, wherein said first configuration is an upright configuration and said second configuration is a reclined configuration.

19. The suspension swing of claim 17, wherein said means for adjusting includes a coupler and a movable member, said coupler being coupled to said seat, said movable member being disposed between a portion of said coupler and said seat, said second suspension line portion being coupled to said movable member and said coupler being configured to guide said movable member for movement relative to said seat.

20. The suspension swing of claim 17, wherein said means for adjusting includes a coupler and a movable member, said movable member including a locking portion, said coupler being configured to receive said locking portion of said movable member to retain said movable member in a position relative to said seat.

21. A swing, comprising:

a seat, said seat having a first end and a second end, said seat first end being fixed relative to said seat second end;

a first flexible suspension line portion, said first flexible suspension line portion being coupled to said seat first end, said first flexible suspension line portion being configured to be coupled to a support member;

a second flexible suspension line portion, said second flexible suspension line portion being one of a rope and a cable, said second flexible suspension line portion being configured to be coupled to the support member; and a movable member, said movable member being movably coupled to said seat, said second flexible suspension line portion being coupled to said movable member.

22. The swing of claim 21, wherein said movable member can be disposed in a first position and in a second position, said seat has a first configuration when said movable member is in said first position and a second configuration when said movable member is in said second position, said first configuration being different than said second configuration.

23. The swing of claim 22, wherein said first configuration is a reclined configuration with respect to a horizontal plane and said second configuration is an upright configuration.

24. A swing, comprising:

a seat, said seat including an upper end and a rear surface;

a movable member, said movable member being coupled to said seat, said movable member being disposable in a first position relative to said seat upper end and in a second position relative to said seat upper end, said movable member including a locking portion;

a coupler, said coupler being coupled to said seat, said coupler including an opening, said movable member being disposed in said opening, said coupler including first and second side walls that define a portion of said opening, said first side wall including an upper recess and a lower recess, and said second side wall including its own upper recess and its own lower recess, said locking portion of said movable member being configured to engage one of said recesses;

a first suspension line portion, said first suspension line portion being coupled to said seat at a first location, said first suspension line portion being configured to be coupled to a support member; and a second suspension line portion, said second suspension line portion being coupled to said movable member at a second location, said second suspension line portion being configured to be coupled to the support member, wherein a distance between said second location and said seat upper end changes when the movable member is moved from said first position to said second position, said seat being disposed in an upright configuration when said movable member is in said first position and in a reclined configuration when said movable member is in said second position.

* * * * *